US006143364A

United States Patent [19]

Nakamori et al.

[11] Patent Number: 6,143,364

[45] Date of Patent: Nov. 7, 2000

[54] HOT DIP PLATING METHOD AND APPARATUS

[75] Inventors: Toshio Nakamori, Ashiya; Masashi Yamamoto, Tokyo; Tamotsu Toki, Nishinomiya; Hirohito Masumoto; Mutsuo Sagara, both of Wakayama; Hiroo Maeda, Kitakyushu, all of Japan

[73] Assignee: Sumitomo Metal Industries, Ltd., Osaka, Japan

[21] Appl. No.: 09/113,304

[22] Filed: Jul. 10, 1998

Related U.S. Application Data

[63] Continuation of application No. PCT/JP97/04080, Nov. 10, 1997.

[30] Foreign Application Priority Data

Nov. 11, 1996 [JP] Japan ..... 8-298986

[51] Int. Cl.[7] ..... B05D 1/18

[52] U.S. Cl. ..... 427/310; 427/329; 427/431; 427/436

[58] Field of Search ..... 427/310, 329, 427/435, 431

[56] References Cited

U.S. PATENT DOCUMENTS 3,027,268 3/1962 Linden ..... 427/310

FOREIGN PATENT DOCUMENTS 45-41086 12/1970 Japan .
46-20564 6/1971 Japan .
58-136759 8/1983 Japan .
61-201767 9/1986 Japan .
64-500042 1/1989 Japan .
3-162557 7/1991 Japan .
4-293761 10/1992 Japan .
4-323356 11/1992 Japan .
6-279968 10/1994 Japan .

OTHER PUBLICATIONS

Abstract of Japan 4–323356, Nov. 1992.

*Primary Examiner*—Katherine A. Bareford
*Attorney, Agent, or Firm*—Burns, Doane, Swecker & Mathis, LLP

[57] ABSTRACT

A batchwise hot dip plating method is performed by dipping a metallic material in a molten metal plating bath, following fluxing by dipping the metallic material in a bath of a fused salt flux (e.g., a mixture of cryolite and one or more alkali metal chlorides and optionally aluminum fluoride) having a melting temperature at least 5° C. higher than the temperature of the molten metal plating bath, which also serves to preheat the metallic material. In the case of hot dip plating with an Al—Zn alloy, particularly a Zn/55% Al/0.5–2% Si alloy, a bare spot-free plated coating having good appearance can be formed by a reduced duration of dipping in the plating bath without post-plating treatment to remove flux residues. The use of a plating tank having a cross section of a round shape such as a semicircular shape or an oblong semielliptic shape, rather than a rectangular box shape, brings about a significantly extended service life of the plating tank.

19 Claims, 1 Drawing Sheet

HOT DIP PLATING METHOD AND APPARATUS

This application is a continuation, of Application No. PCT/JP97/04080, filed Nov. 10, 1997, and which designated the United States of America.

TECHNICAL FIELD

The present invention relates to a method and apparatus for hot dip plating of metallic materials, and in particular to such a method and an apparatus which are suitable for hot dip plating of a ferrous material with an aluminum-zinc (Al—Zn) alloy after treatment with a flux.

BACKGROUND ART

Ferrous materials are widely used in building structures. Since they are readily corroded, various means have been employed to protect them from corrosion. Among these means, hot dip zinc plating or galvanizing is applied to a wide variety of ferrous materials ranging from small-sized joint members such as bolts to large-sized structural members such as H-shaped steels. However, a zinc coating formed by hot dip galvanizing does not have good resistance against corrosion or damage caused by salt which tends to occur in areas near the seashore, for example. Therefore, there was a need for a corrosion-preventing coating for ferrous materials which possesses improved corrosion resistance over a zinc coating.

Under the circumstances, it was found that hot dip Al—Zn alloy plating could produce a coating having outstandingly superior corrosion resistance compared to hot dip galvanizing. It was also confirmed that hot dip plating with an Al—Zn alloy containing about 55% Al, about 1.5% Si, and a balance of Zn was most suitable from the viewpoint of improvement not only in corrosion resistance of the coating itself but also in protection of the ferrous substrate by sacrificial corrosion of the coating. This Al—Zn alloy plating is now applied to a considerable proportion of mass-produced corrosion-preventing thin steel sheets.

In general, hot dip plating of a thin steel sheet is carried out in a continuous hot dip plating apparatus which comprises a continuous annealing unit and a hot dip plating tank which is located on the outlet side (downstream) of the continuous annealing unit. In a typical process using such a continuous hot dip plating apparatus, a steel sheet is initially heated in a non-oxidizing furnace kept in a very slightly oxidizing atmosphere for cleaning, and then is passed into a reducing furnace connected to the non-oxidizing furnace. In the reducing furnace, the steel sheet is subjected to reduction and annealing in a hydrogen-containing atmosphere. Subsequently, the steel sheet is introduced, without exposure to air, into a hot dip plating tank to apply hot dip coating thereto. Thus, the steel sheet is shielded from air throughout the process from the cleaning step to the entry into the hot dip plating tank, and degreasing of the steel sheet and reduction of an oxide layer (oxide scale or film) formed on the surface thereof are performed before the steel sheet is introduced into the hot dip plating tank. Therefore, hot dip plating of the steel sheet occurs under such conditions that it can be readily wetted by the molten metal in the plating tank. Although this type of continuous hot dip plating apparatus was developed for the purpose of galvanizing, it is also used to perform hot dip aluminum or Al—Zn alloy plating. Thus, hot dip Zn—Al alloy plating can be performed by utilizing the same equipment and system used for hot dip galvanizing, although it is necessary to modify the composition of the plating bath and the operating conditions accordingly.

In contrast, hot dip plating of ferrous materials other than thin steel sheets, for example, continuous hot dip plating of a steel wire, or batchwise hot dip plating of structural members or other various steel parts has been performed by dipping the steel material in a molten metal bath (plating bath) in air. In this case, even if the steel material is preliminarily degreased and pickled prior to plating, it is inevitably oxidized prior to entry into the plating bath. Therefore, a flux comprising one or more salts is applied to the steel material prior to plating in order to remove the oxide layer, which has been inevitably formed on the surface of the steel material, by fusion and thereby promote wetting of the steel material by the molten metal in the plating bath.

The flux can be applied either by a dry process or a wet process.

In the dry process, a steel material is treated with an aqueous solution of a flux and then dried such that the flux is deposited on the surface of the steel material. The steel material having the flux deposited thereon is thereafter dipped in a molten metal bath to perform hot dip plating.

In the wet process, a flux is placed onto a molten metal bath in a plating tank. The flux is fused by the high temperature of the molten metal bath and due to its lower specific gravity the fused flux floats on the molten metal bath. A bed of the fused flux having an appropriate thickness is formed onto the molten metal bath in this manner. When a steel material is introduced into the molten metal bath, it passes through the floating bed of the fused flux and is coated with the flux before entering the molten metal bath. In this case, when the steel material is withdrawn from the molten metal bath, it again passes through the floating bed of the fused flux such that the flux is deposited on the surface of the plated steel material. As a result, subsequent to hot dip plating, it is necessary to perform an additional step of removing the flux residues which remain deposited on the plated surface, thereby making the process complicated.

Flux treatment for hot dip galvanizing, for example, is usually performed by the dry process, which is simpler in operation, using an aqueous solution containing zinc chloride and ammonium chloride as a flux material. However, this flux cannot be used with a molten metal bath which contains aluminum, as employed in hot dip aluminizing (aluminum plating) or Al—Zn alloy plating, since aluminum in the molten metal bath reacts with a salt, primarily $NH_4Cl$, present in the flux to form readily subliming $AlCl_3$, thereby causing the flux to decompose. As a result, the function of the flux is significantly damaged, thereby causing the formation of a number of bare (uncovered) spots in the resulting plated coating.

For this reason, flux treatment for hot dip aluminizing is normally performed by the wet process using a flux which comprises one or more fluoride salts. However, this flux has a relatively high melting point. Therefore, when it is used for hot dip Al—Zn alloy plating, it does not exhibit an adequate effect due to the lower melting point of the Al—Zn alloy compared to aluminum metal.

Several fluxes have been proposed which are suitable for use with hot dip Al—Zn alloy plating.

For example, Japanese Patent Application Laid-Open No. 58-136759(1983) discloses a flux composition for use with Al—Zn alloy plating which comprises zinc chloride and at least one additional salt selected from chlorides, fluorides, and silicofluorides of an alkali or alkaline earth metal. This flux is conveniently applied by the dry process. However, its function as a flux is not satisfactory. Namely, it tends to cause the occurrence of bare spots more frequently with increasing Al content in the molten metal bath. This phenomenon becomes striking particularly with 55% Al—Zn alloy plating, which has a high Al content and produces a highly corrosion-resistant coating.

Japanese Patent Application Laid-Open No. 3-162557 (1991) discloses a flux composition for use with hot dip Al—Zn alloy plating which comprises zinc chloride and ammonium chloride at a weight ratio of from 10:1 to 30:1. This flux is also used by the dry process and it gives fairly good results in plating of thin sheets. However, the occurrence of bare spots increases as the plating temperature (temperature of the plating bath) increases. Therefore, in the case of 55% Al—Zn alloy plating in which the plating temperature is high, bare spots may often be formed in the resulting plated coating unless the ferrous material to be plated is a thin sheet.

Japanese Patent Application Laid-Open No. 4-293761 (1992) discloses a flux composition for use with hot dip Al alloy plating which comprises chlorides salts of zinc, lithium, sodium, and potassium. The use of this flux is costly since it is applied by the wet process, and among the four chloride constituents, the most expensive lithium chloride comprises a major proportion (40–60%) of the flux. For plating of thick ferrous materials, its effect on prevention of the formation of bare spots is inadequate. In addition, hot dip plating must be followed by removal of the flux residues deposited on the plated surface.

Japanese Patent Application Laid-Open No. 4-323356 (1992) discloses a flux composition for use with hot dip Al—Zn alloy plating which comprises an Al-containing alkali metal fluoride (e.g., cryolite) and an alkaline earth metal chloride. This flux is also used by the wet process and is disclosed as being particularly suitable for use in 55% Al—Zn alloy plating. However, it involves a problem that scaffolding of the flux (the phenomenon that the flux is solidified to make a shelf or scaffold and create a cavity between the molten metal and the solidified flux) tends to occur. Another problem is that since this flux contains a fluoride salt, the flux residues deposited and solidified on the plated surface during withdrawal of the plated steel material from the molten metal bath cannot be readily removed by rinsing with water or similar means due to the presence of the fluoride salt. As a result, the appearance of the plated surface becomes inferior.

Thus, when the conventional fluxes are used particularly for hot dip Al—Zn alloy plating having a relatively high Al content, i.e., on the order of 45% or higher, they cannot perform as a flux sufficiently by the dry process, and the formation of bare spots tends to occur frequently. When they are used by the wet process, the fluxes themselves may be expensive, or they may cause the scaffolding phenomenon, or removal of the flux residues deposited on the plated surface may be difficult, thereby causing the plated surface to have a deteriorated appearance.

Instead of using a flux, it is proposed to apply duplex hot dip plating to a steel material, i.e., by performing hot dip galvanizing followed by hot dip Al—Zn alloy plating, for example, in Japanese Patent Publication No. 61-201767 (1986). However, this technique requires that a hot dip plating operation be performed twice, which is naturally disadvantageous from the viewpoint of manufacturing costs.

Furthermore, in a conventional hot dip Al—Zn alloy plating method, a preheating step, which can be performed prior to plating, is either totally eliminated or insufficiently performed. Therefore, the duration of dipping in the molten metal plating bath is as long as at least 20 seconds and usually from 30 seconds to 180 seconds. In particular, when the Al—Zn alloy contains from 45% to 60% Al, the temperature of the plating bath becomes high and hence a brittle intermetallic compound layer formed at the interface between the metal substrate and the plated coating (such layer being hereunder referred to as an "interfacial alloy layer") is caused to grow significantly during dipping in the plating bath, thereby adversely affecting the deformability or workability of the plated coating.

A plating tank which is used for hot dip Al—Zn alloy plating is normally made of a refractory material, a ceramic, or graphite, which is hard to corrode. Because of rapid corrosion, a ferrous material is not suitable as a material for such a plating tank. The shape of the plating tank is normally a rectangular box, since such a shape occupies a small space and receives a large volume of a molten metal bath. In a batchwise operation of hot dip plating, the molten metal bath in the plating tank is allowed to solidify when the operation is suspended for a long period, and it is heated to remelt the metal bath before the operation is resumed. Accordingly, solidification and melting of the metal bath are repeated in the plating tank. When the plating tank is made of a refractory material or the like, the inner wall of the plating tank tends to be cracked by the repeated solidification and melting. This significantly decreases the service life of the plating tank and may eventually cause leakage of the molten metal bath through the resulting cracks of the plating tank, which is very dangerous.

DISCLOSURE OF THE INVENTION

It is an object of the present invention to provide a hot dip plating method and apparatus suitable for use with hot dip Al—Zn alloy plating in which the above-described problems involved in the prior art are eliminated.

Another object of the present invention is to provide a hot dip plating method and apparatus which are suitable for use with Al—Zn alloy plating containing 45–60% Al and a minor amount of Si and which is capable of forming a plated coating having improved workability.

The present invention provides a method for hot dip plating of a metallic material comprising, prior to plating, dipping a metallic material to be plated in a bath of a fused salt flux, and then dipping the metallic material in a molten metal plating bath to perform hot dip plating thereon, wherein the fused salt flux has a melting temperature at least 5° C. higher than the temperature of the molten metal plating bath.

In accordance with the present invention, a metallic material to be plated, which has been subjected to pretreatment in the appropriate manner, is initially dipped in a fused salt flux bath which is made of fused salts capable of functioning as a flux and having a melting temperature higher than the temperature of the plating bath used for hot dip plating. By dipping the metallic material in the fused salt flux bath, the metallic material is preheated and at the same time it is activated by the action of the flux. As the metallic material is withdrawn from the fused salt flux bath, a coating of the flux is formed on the surface of the metallic material.

Subsequently, the metallic material having a flux coating on the surface thereof is quickly dipped into a molten metal plating bath. Before the entry of the metallic material into the plating bath, the flux coating serves to protect the underlying metallic material from oxidation. As the metallic material is dipped into the molten metal plating bath, the flux coating is caused to be stripped off from the surface of the metallic material and float on the molten metal bath in the plating tank. If the flux floating on the molten metal bath has a melting temperature lower than the temperature of the molten metal bath, it will form a liquid layer (fused flux layer) on the molten metal bath. As a result, when the metallic material is withdrawn from the plating bath, the flux will be deposited on the plated surface of the metallic material. However, the melting temperature of the flux is higher than the temperature of the molten metal plating bath, as described above. In this case, the flux floats on the molten metal bath in the form of solids, which are quite easy to remove by skimming. Therefore, the flux can be prevented from being deposited on the plated surface when the plated metallic material is withdrawn from the plating bath, and it is possible to readily produce hot dip plated articles with good quality.

The dipping of the metallic material in the fused salt flux bath having a temperature higher than that of the plating bath prior to hot dip plating can rapidly elevate the temperature of the metallic material in a short period of dipping. Thus, this dipping in the molten salt flux bath also serves to preheat the metallic material. As a result, in the subsequent hot dip plating stage, the duration of dipping in the molten metal plating bath can be reduced, thereby making it possible to significantly suppress the growth of the interfacial alloy layer caused by dipping in the plating bath and prevent a loss of workability of the plated coating.

In a preferred embodiment of the present invention, the molten metal is an Al—Zn alloy containing 45%–60% by weight of Al and 0.5%–2% by weight of Si, and the flux is a mixture of cryolite and at least one alkali metal chloride or a mixture of cryolite, at least one alkali metal chloride, and aluminum fluoride.

Other objects, advantages, and features of the present invention will become apparent from the following detailed description of the present invention, which is to be considered in all respects as illustrative and not restrictive.

BEST MODES FOR CARRYING OUT THE INVENTION

Figure 1:
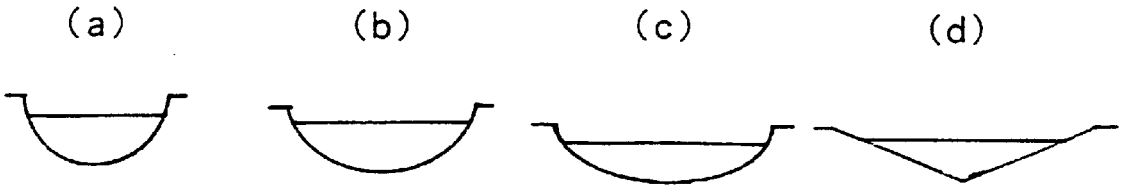
FIGS. 1(*a*), 1(*b*), 1(*c*), and 1(*d*) are schematic diagrams showing the shapes of plating tanks which are suitable for use in a hot dip Zn—Al alloy plating according to the present invention, and FIGS. 2(*a*), 2(*b*) and 2(*c*) are schematic diagrams showing the mechanism by which cracking occurs in a conventional rectangular plating tank.

In accordance with the present invention, hot dip plating, more specifically hot dip Al—Zn alloy plating, in particular, containing 40% or more Al, can be performed satisfactorily using a flux, thereby producing a plated article which is free from bare spots and has improved surface appearance and workability in a short time of operation and with ease.

In the present invention, besides a plating tank which receives a molten metal, a flux tank is desirably provided to receive and fuse a flux therein. Thus, the flux tank is charged with a flux, which is comprised of one or more salts and which has a composition selected such that it has a melting temperature higher than the temperature of the molten metal plating bath, and the flux is heated to fuse therein.

The melting temperature of the flux should be at least 5° C., preferably at least 15° C., and more preferably at least 30° C. higher than the temperature of the molten metal plating bath. If the difference between the melting temperature of the flux and the temperature of the molten metal plating bath is less than 5° C., the flux brought into the plating bath will not solidify sufficiently on the molten metal and the plated surface will tend to be contaminated with the flux during withdrawal from the plating bath. If the melting temperature of the flux is too high, the metallic material to be plated will be preheated in the flux tank to an extremely high temperature, which is not desirable. The difference between the melting temperature of the flux and the temperature of the molten metal plating bath is preferably at most 80° C. and more preferably at most 60° C.

In conventional wet process fluxing, a flux is fused by the temperature of the molten metal plating bath, thereby causing the flux to float on the molten metal. Therefore, the composition of the flux must be selected such that the melting temperature of the flux is lower than the temperature of the molten metal plating bath. In this respect, the concept of the present invention in which the flux used has a melting temperature higher than the temperature of the molten metal plating bath is totally different from conventional wet process fluxing.

As the flux, any salts can be used as long as they can function as a flux and are not volatile at the melting temperature of the flux. For example, halides, particularly chlorides and fluorides of alkali metals, alkaline earth metals, aluminum, zinc, and similar metals, as well as alkali metal borofluorides can be used. Usually, two or more compounds selected from these salts are used to form a mixture having a composition which is selected such that the mixture has a melting temperature at least 5° C. higher than the temperature of the molten metal plating bath.

In the case where the molten metal used for plating is an Al—Zn alloy containing 45%–60% Al and 0.5%–2% Si, the temperature of the molten metal plating bath is normally between 570° C. and 610° C. In this case, the flux is preferably a combination of cryolite and at least one alkali metal chloride (e.g., lithium chloride, sodium chloride, potassium chloride) to which aluminum fluoride may be optionally added, since it has an adequate function as a flux even for such an Al—Zn alloy plating having a high Al content and it is easy to select a composition having a melting temperature at least 5° C. higher than the above-described plating bath temperature.

In this case, however, the composition of the flux is not limited to the above-described combination, and a cryolite-free flux composition may be selected. For example, a combination of one or more alkali metal chlorides and one or more alkali metal fluorides can provide a mixture which functions as a flux and which has a melting temperature at least 5° C. higher than the temperature of the molten metal plating bath. In such a combination, it is necessary to incorporate a large amount of lithium chloride, which has a lower melting point, in the flux, thereby increasing the material costs. In addition, its performance as a flux is more or less inferior to that of the above-described cryolite-containing combination.

Typical metallic materials which can be subjected to hot dip plating according to the present invention are steel materials (e.g., steel wires, shaped steels, steel pipes, steel fixtures and joints such as bolts, nuts, screws, or the like), although they are not limited to these materials. For example, highly corrosion-resistant hot dip Al—Zn alloy-plated steel sheets, particularly hot dip 55% Al—Zn alloy-plated steel sheets have been used as building materials for roofs or exterior walls, not only in those areas near the seashore where corrosion or damage of ferrous materials caused by salt occurs severely, but also in other areas. In this case, small-sized joint members for use in joining the plated steel sheets may also be subjected to the same hot dip Al—Zn alloy plating. As a result, corrosion resistance of the joint members is ensured, and at the same time it is possible to prevent dissolution of the coated metal, which results from the action of local cells formed by contact of different metallic materials in the joining interface, thereby improving the durability of the plated coating. In addition to Al—Zn alloy plating of small-sized joint members, the hot dip plating method according to the present invention can also be applied to large-sized members such as shaped steels. Besides common carbon steels, various metallic materials including alloy steels, Ni alloys, and ferritic stainless steels can be plated by the method.

The metallic material to be plated is desirably subjected to normal pretreatment prior to dipping in the fused salt flux bath in the flux tank in accordance with the present invention. For example, when the metallic material is a steel or other ferrous product, the pretreatment includes at least one step selected from a degreasing step using a warm aqueous solution of sodium orthosilicate, a caustic alkali, or sodium carbonate, a degreasing step using an organic solvent, and a pickling step using an aqueous acidic solution, such as hydrochloric acid or sulfuric acid solution.

The temperature of the fused salt flux bath in the flux tank is not critical as long as it is higher than the melting temperature of the flux. By providing the flux tank with an appropriate thermostat means, which may be the same one used in the plating tank, the flux bath can sufficiently work even at a temperature of a few degrees Celsius higher than the melting temperature of the flux. An excessively high temperature of the fused salt flux bath is disadvantageous from the viewpoint of thermal energy costs and may cause thermal damage to the metallic material to be plated. The temperature of the fused salt flux bath is preferably such that the temperature difference from the molten metal plating bath is at most 100° C. and more preferably at most 70° C. The duration of dipping in the flux bath may be very short, usually on the order of 10 seconds or less, such as from 1 second to several seconds. In view of the fact that this dipping in the flux bath also serves to preheat the metallic material, when the metallic material to be plated has a large thickness, the duration of dipping may be extended so as to ensure that the metallic material is sufficiently preheated.

As described above, the metallic material exiting from the flux tank is protected by the flux deposited on the surface of the material. Therefore, upon exposure to air, the surface of the metallic material is not susceptible to oxidation, and hence there is no need to shield the metallic material from air while it is transferred from the flux tank to the hot dip plating tank. In order to suppress a temperature drop during the transfer of the metallic material which has been preheated in the flux tank, it is preferable to transfer the metallic material from the flux tank to the plating tank as quickly as possible.

The material constituting the hot dip plating tank may be any material which is inert to the molten metal plating bath. As described above, a steel (including a stainless steel) tends to rapidly corrode. Examples of a suitable material include a refractory material (e.g., alumina), a ceramic material (e.g., silicon nitride), or graphite. Preferably, the material constituting the flux tank for receiving the fused salt flux may be the same material as described above.

Preferably, the plating tank has an inner wall with a round shape, rather than a conventional cubic or rectangular box shape. The round inner wall shape may have a vertical cross section of the inner wall which is composed of consecutive non-angular sloping curves extending upwardly and outwardly from the center of the bottom of the tank. Examples of such a plating tank include those in which the vertical cross section of the inner wall has a semicircular, semielliptic or parabolic, or reverse conical shape, as shown in FIG. 1. The depth of the inner wall shape of the plating tank is preferably equal to or smaller than the (longer) diameter of the opening thereof. The opening of the inner wall shape of the plating tank is preferably round (e.g., circular or elliptic), although it may have an angular portion.

With a plating tank having such a round-shaped inner wall, when repeated solidification and melting of the molten metal bath take place in the tank by solidifying the molten metal during long-term suspensions of hot dip plating operations, the plating tank is less susceptible to cracking and the service life of the plating time is significantly extended, as described below.

Figure 2:
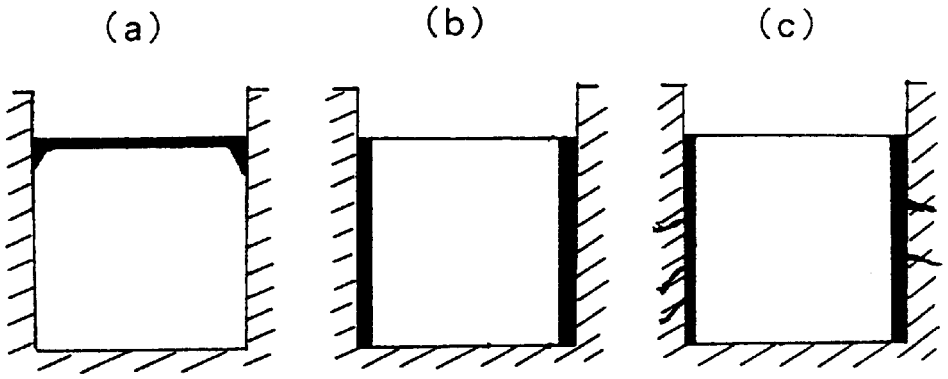

With a plating tank having a rectangular box-shaped inner wall, the flux brought into the plating tank is floating on the molten metal bath, as shown in FIG. 2(*a*), when the plating bath is in a molten state. When the plating bath is solidified, the flux is forced to gather in the interstice formed between the solidified plating bath and the inner wall of the plating tank, as shown in FIG. 2(*b*), due to a difference in coefficient of thermal shrinkage between the plating bath and the flux. Subsequent remelting of the plating bath gives rise to thermal expansion of the plating bath, which causes a stress on the inner wall of the plating tank through the flux surrounding the plating bath, and the plating tank, when it is made of a relatively brittle material such as a refractory material, cannot withstand the stress applied by the thermal expansion and tends to crack, as shown in FIG. 2(*c*).

In contrast, with a plating tank having a round-shaped inner wall as shown in FIGS. 1(*a*)–1(*d*), when the plating bath is remelted, thermal expansion of the plating bath is permitted to take place upwards and the stress applied to the inner wall of the plating tank through the flux is significantly relaxed, thereby making the inner wall less susceptible to cracking. Such a round plating bath is very useful not only for the hot dip plating method according to the present invention, but also as a plating tank with a flux floating on the molten metal bath according to wet process fluxing.

The plating tank is preferably provided with a conventional skimming means. In the method according to the present invention, the flux has a melting temperature which is higher than the temperature of the molten metal plating bath. Thus, the flux which has been stripped off from the metallic material to be plated upon contact with the molten metal plating bath solidifies in the plating bath and floats as solids on the molten metal in the plating bath. Therefore, the floating solid flux can be easily removed by skimming. In the case where the hot dip plating is operated batchwise, skimming may be performed in the intervals between plating operations. In continuous hot dip plating as employed for wires or the like, skimming can be performed periodically or constantly as required. As a result of skimming, the metallic material withdrawn from the molten metal plating bath has a plated coating having no or little flux deposited thereon, and hence it does not need to be subjected to additional treatment for flux removal as employed in conventional wet process fluxing.

In accordance with the present invention, prior to hot dip plating, the metallic material to be plated is preheated in a flux tank kept at a temperature which is higher than the temperature of the plating bath. As a result, the duration of dipping in the molten metal plating bath, which has been as long as from 30 to 180 seconds, for example, in the prior art, can be greatly reduced to 10 seconds or less, for example, or even to several seconds or less. Accordingly, taking the duration of dipping in the flux tank (which may usually be as short as several seconds or less) into account, the total operating time required for hot dip plating can be significantly reduced.

Furthermore, as a result of the greatly reduced duration of dipping in the molten metal plating bath, the growth of the brittle alloy layer formed at the interface between the metallic substrate and the plated coating is significantly suppressed and hence the plated coating has good workability which is adequate for end uses. Thus, it is possible to form a quality plated coating having improved workability and appearance. It is also possible to remarkably reduce the amount of dross formed per unit weight of plated coating.

EXAMPLES

The following examples are given to further illustrate the present invention.

Example 1 hot-rolled steel sheet measuring 40 mm×120 mm×3 mm (thickness) was subjected to pre-plating treatment, prior to fluxing, by degreasing with an aqueous sodium orthosilicate solution, rinsing with water, and pickling with an aqueous 10% hydrochloric acid solution.

The following two fluxing methods A and B were employed for comparison.

Method A: In accordance with conventional wet process fluxing, a flux is added to a plating tank in an amount sufficient to form a fused salt flux layer about 30 mm-thick on a molten metal plating bath, and a steel sheet which has been pretreated as described above is dipped in the plating bath without preheating.

Method B: In accordance with the present invention, a flux tank in which a fused salt flux bath is received is installed in the vicinity of a hot dip plating tank. A steel sheet which has been pretreated as described above is dipped in the fused salt flux bath for 5 seconds for the purpose of fluxing and preheating, then is withdrawn from the flux bath and dipped into the molten metal plating bath in the plating tank as quickly as possible.

The compositions shown in Table 1 were used as fluxes. Each flux was used in both the fluxing methods A and B to perform fluxing and hot dip plating. The temperature of the fused salt flux bath in the flux tank in method B was 630° C. except for Fluxes 5 and 6. The temperature of the flux bath of Flux 5 or 6 was 5° C. higher than the melting temperature of the flux.

TABLE 1

| Flux No. | Composition of Flux (wt %) | Melting Temp. |
|---|---|---|
| 1 | 30% Cryolite, 25% NaCl, 25% KCl, 20% $AlF_3$ | 585° C. |
| 2 | 50% KCl, 30% Cryolite, 20% $AlF_3$ | 555° C. |
| 3 | 75% $ZnCl_2$, 25% $NH_4Cl$ | <440° C. |
| 4 | 20% NaCl, 20% KCl, 10% LiCl, 20% $ZnF_2$, 20% $KBF_4$, 10% LiF | <440° C. |
| 5 | 45% NaCl, 30% KCl, 15% Cryolite, 10% $AlF_3$ | 640° C. |
| 6 | 35% NaCl, 35% KCl, 30% Cryolite | 630° C. |
| 7 | 25% NaCl, 45% LiCl, 30% NaF | 605° C. |

The metal used for plating was a 55% Al-1.6% Si—Zn alloy and the temperature of the hot dip plating bath was 590° C. The plating tank used to receive the plating bath was constituted by a 20 mm-thick, semispherical iron outer shell having a 30 mm-thick inner wall of an alumina-based refractory material of the same shape fitted inside the outer shell. The inside diameter and the depth of the inner wall were both 500 mm.

The duration of dipping in the plating bath was fixed at 30 seconds in method A or 10 seconds in method B. In fluxing method B, 10 pieces of the steel sheet were successively subjected to hot dip plating after the fluxing while the flux floating as solids on the molten metal plating bath was skimmed off. In fluxing method A, one piece of the steel sheet was used to perform hot dip plating. The molten metal plating bath was renewed for each plating test run.

Each steel sheet withdrawn from the molten metal plating bath was quenched in water and brushed in rinsing water before the plated coating was visually observed to evaluate for bare spots and appearance (degree of dirt). The results are shown in Table 2. In fluxing method B, the results shown in Table 2 are those obtained with the tenth (last) run of plating. The bare spots and appearance shown in Table 2 were evaluated as follows:

Bare Spots

○: No bare spots observed;

Δ: Ten or less pinhole-like bare spots observed;

X : More than ten pinhole-like bare spots observed.

Appearance

○: Good;

Δ: Slight deposition of flux residues or the like;

X : Considerable deposition of flux residues or the like.

TABLE 2

| Run No. | Fluxing Method | Fluxing Flux No. | Fluxing Bare Spots | Fluxing Appearance | Remarks | |
|---|---|---|---|---|---|---|
| 1 | A | 1 | ○ | X | | Comparative |
| 2 | A | 2 | ○ | X | | Comparative |
| 3 | A | 3 | X | X | Flux evaporated remarkably | Comparative |
| 4 | A | 4 | Δ | X | | Comparative |
| 5 | A | 5 | — | — | Plating not operable by solidification of flux on plating bath | Comparative |
| 6 | A | 6 | — | — | | Comparative |
| 7 | A | 7 | — | — | | Comparative |
| 8 | B | 1 | ○ | X | | Comparative |
| 9 | B | 2 | ○ | X | | Comparative |
| 10 | B | 3 | Δ | X | | Comparative |
| 11 | B | 4 | Δ | X | | Comparative |
| 12 | B | 5 | ○ | ○ | | This invention |
| 13 | B | 6 | ○ | ○ | | This invention |
| 14 | B | 7 | ○ | ○~ Δ | Slightly dirty surface | This invention |

As can be seen from Table 2, in each of the hot dip Al—Zn alloy plating runs according to the present invention in which fluxes 5 to 7 each having a melting temperature of at least 5° C. higher than the temperature of the molten metal plating bath were used by fluxing method B, the resulting plated steel sheet was of good quality with no bare spots in the plated coating and little or no dirt in the appearance thereof since the flux could exhibit its function adequately and it could be easily removed from the molten metal plating bath during hot dip plating. In most cases, even prior to brushing in rinsing water, there were observed no flux residues deposited on the plated surface. In flux 7 which was free from cryolite, a slight amount of dirt was observed on the plated surface. Thus, a cryolite-containing flux such as a mixture of cryolite and one or more alkali metal chlorides and optionally aluminum fluoride exhibited particularly good results.

In contrast, even if the fluxing was performed by method B, the use of Fluxes 1 to 4 which had a melting temperature below the temperature of the molten metal plating bath caused the flux, which had been stripped off in the molten metal plating bath, to float in the fused state on the molten metal. The fused flux floating on the molten metal was difficult to remove and apt to be deposited on the plated surface, thereby causing a dirty appearance of the plated coating. In addition, in cryolite-free Fluxes 3 and 4, bare spots were found.

On the other hand, in the conventional wet process fluxing method A in which a flux was placed atop a molten metal plating bath, the use of Fluxes 5 to 7 which had a melting temperature higher than the temperature of the plating bath naturally made plating impossible. However, even the use of Fluxes 1 to 4 which had a melting temperature lower than the temperature of the plating bath caused the plated coating to have a remarkably dirty appearance. In conventional wet process fluxing, it is essential to perform a post-plating treatment for removal of the flux residues deposited on the plated surface, but it is difficult to completely remove the solidified flux residues. Even if they can be removed, the appearance of the plated coating will unavoidably be deteriorated.

In order to examine the service life of the semispherical plating tank used in this example, the plating tank was charged with the molten metal plating bath containing a certain amount of Flux 6 shown in FIG. 1 and subjected to repeated melting and solidification cycles between room temperature (solidification of the plating bath) and 620° C. (remelting thereof). At the end of 20 cycles, no cracks of the inner wall were observed. For comparison, a rectangular box-shaped plating tank measuring 1000 mm (length)×500 mm (width)×1000 mm (depth) was fabricated from the same materials and with the same thicknesses of the iron outer shell and refractory inner wall as the semispherical plating tank. When this box-shaped plating tank was subjected to the same melting and solidification cycles as above, fine cracks were found in the inner wall after 2 cycles and leakage of the plating bath due to the formation of big cracks occurred after 5 cycles.

Example 2

A steel sheet was subjected to hot dip plating (duration of dipping: 30 seconds) in the same manner as described in Example 1 using wet process fluxing (method A) with Flux 1. After the resulting Al—Zn alloy-plated steel sheet was withdrawn from the plating bath, it was pickled with a 1% hydrochloric acid solution to remove the dirt on the plated surface and was used as a comparative test piece.

Separately, also in the same manner as described in Example b 1, a steel sheet was subjected to fluxing with Flux 6 by method B (duration of dipping: 5 seconds) followed by hot dip plating (duration of dipping: 2 seconds). The resulting Al—Zn alloy-plated steel sheet was cleaned by brushing in rinsing water and used as a test piece according to the present invention.

The two test pieces were subjected to a 2T bend test and the outer surface of each bent R portion of the test piece was visually observed. In the test piece according to the present invention, fine cracks were found but no delamination of the plated coating occurred. On the contrary, in the comparative test piece, part of the plated coating was delaminated.

INDUSTRIAL APPLICABILITY

In the hot dip plating method using a flux in accordance with the present invention, even in the case of hot dip Al—Zn alloy plating for which it was difficult to obtain a good appearance of the plated coating by conventional fluxing methods, a dirt-free, quality plated coating can be obtained with sufficient performance of the flux to prevent the formation of bare spots in the plated coating.

Moreover, in accordance with the present invention, since the fluxing treatment also serves to preheat the metallic material to be plated, there is no need to perform a preheating step prior to hot dip plating, and the duration of dipping in the molten metal plating bath can be remarkably reduced. As a result, taking the time required for fluxing into account, the total operating time required for hot dip plating can be reduced. Furthermore, as a result of the greatly reduced duration of dipping in the molten metal plating bath, the growth of a brittle interfacial alloy layer is significantly suppressed, thereby producing a plated coating having improved workability with the formation of a remarkably reduced amount of dross. Furthermore, the operation can be simplified because there is no need to perform a post-plating treatment to remove flux residues deposited on the plated coating, which had to be performed by conventional wet process fluxing.

What is claimed is:

1. A method for hot dip plating of a metallic material comprising, prior to plating, dipping a metallic material to be plated in a bath of a fused salt flux, and then dipping the metallic material in a molten metal plating bath to perform hot dip plating thereon, wherein the fused salt flux has a melting temperature at least 5° C. higher than the temperature of the molten metal plating bath.

2. The hot dip plating method according to claim 1 wherein the molten metal plating bath is an aluminum-zinc alloy containing at least 40% by weight of Al.

3. The hot dip plating method according to claim 2 wherein the molten metal plating bath is an aluminum-zinc alloy containing 45%–60% by weight of Al and 0.5%–2% by weight of Si and wherein the fused salt flux comprises of two or more salts selected from chlorides and fluorides of alkali metals, alkaline earth metals, aluminum, and zinc.

4. The hot dip plating method according to claim 3 wherein the fused salt flux is selected from a mixture of cryolite and at least one alkali metal chloride, and a mixture of cryolite, at least one alkali metal chloride, and aluminum fluoride.

5. The hot dip plating method according to claim 1 wherein the melting temperature of the fused salt flux is 15° C.–80° C. higher than the temperature of the molten metal plating bath.

6. The hot dip plating method according to claim 5 wherein the melting temperature of the fused salt flux is 30° C.–60° C. higher than the temperature of the molten metal plating bath.

7. The hot dip plating method according to claim 1 wherein the duration of dipping in the fused salt flux bath is at most 10 seconds.

8. The hot dip plating method according to claim 1 wherein the duration of dipping in the molten metal plating bath is at most 10 seconds.

9. The hot dip plating method according to claim 1, wherein the metallic material has a coating of the flux after the metallic material is withdrawn from the bath of the fused salt flux and the flux coating is removed from the metallic material when the metallic material is dipped in the molten plating bath, flux floating on the molten plating bath consisting essentially of solid pieces of flux.

10. The hot dip plating method according to claim 1, wherein the molten plating bath includes pieces of solid flux floating thereon.

11. The hot dip plating method according to claim 1, wherein the metallic material is withdrawn from the bath of the fused salt flux with a flux coating thereon, the flux coating protecting the metallic material from oxidation during transfer to the molten plating bath.

12. The hot dip plating method according to claim 1, wherein the bath of the fused salt flux is at a higher temperature than the molten plating bath.

13. The hot dip plating method according to claim 1, wherein the metallic material is heated by the bath of the fused salt flux.

14. The hot dip plating method according to claim 1, wherein the bath of the fused salt flux is at a temperature above but less than 100° C. above the temperature of the molten plating bath.

15. The hot dip plating method according to claim 1, wherein the molten plating bath is at a temperature of 570 to 610° C.

16. The hot dip plating method according to claim 1, wherein the metallic material comprises steel sheet, steel wire, shaped steel, steel pipe, a steel fixture, a bolt, a nut or a screw.

17. The hot dip plating method according to claim 1, wherein the method further comprises subjecting the metallic material to degreasing prior to the step of dipping the metallic material in the bath of the fused salt flux.

18. The hot dip plating method according to claim 1, wherein after the step of dipping in the bath of the fused salt flux the metallic material is transported in an air environment to the molten plating bath.

19. The hot dip plating method according to claim 1, wherein the method further comprises skimming floating solid pieces of flux from an upper surface of the molten plating bath.

* * * * *